US007497490B2

(12) United States Patent
Yamaguchi

(10) Patent No.: US 7,497,490 B2
(45) Date of Patent: Mar. 3, 2009

(54) TELESCOPIC STAY

(75) Inventor: Koushi Yamaguchi, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 119 days.

(21) Appl. No.: 11/570,363

(22) PCT Filed: Jun. 14, 2005

(86) PCT No.: PCT/JP2005/010828

§ 371 (c)(1),
(2), (4) Date: Dec. 11, 2006

(87) PCT Pub. No.: WO2005/124076

PCT Pub. Date: Dec. 29, 2005

(65) Prior Publication Data

US 2008/0042449 A1 Feb. 21, 2008

(30) Foreign Application Priority Data

Jun. 15, 2004 (JP) ..... 2004-177391

(51) Int. Cl.
*E05C 17/02* (2006.01)
*E05C 19/00* (2006.01)

(52) U.S. Cl. ..... 292/262; 292/259 R; 292/263; 292/265; 292/288; 292/338; 70/94; 49/449

(58) Field of Classification Search ..... 292/259 R, 292/262, 263, 265, 288, 289, 338, 339, DIG. 37, 292/DIG. 61, 152; 70/93, 94, DIG. 64, DIG. 66; 49/394, 449–451; 24/115 G; 403/109.1–109.8
See application file for complete search history.

(56) References Cited

U.S. PATENT DOCUMENTS 1,581,185 A * 4/1926 Ellis ..... 292/262
1,599,971 A * 9/1926 Melson ..... 292/265
1,954,739 A * 4/1934 Lyons ..... 292/305
D244,004 S * 4/1977 Searer ..... D8/330
4,385,849 A * 5/1983 Crain ..... 403/109.3
4,409,866 A * 10/1983 McBride ..... 81/177.2
5,102,173 A * 4/1992 Schallern ..... 292/288
6,079,894 A * 6/2000 Obitts ..... 403/109.3
6,352,290 B1 * 3/2002 Scottino ..... 292/259 R
6,854,916 B2 * 2/2005 Hsieh ..... 403/109.3
6,883,208 B1 * 4/2005 Huang ..... 16/429
2006/0062632 A1 * 3/2006 Jang ..... 403/109.6
2007/0003361 A1 * 1/2007 Wang ..... 403/109.3

FOREIGN PATENT DOCUMENTS

GB 2194730 A * 3/1988
JP 07-317415 A 12/1995
JP 08-144630 A 6/1996
JP 08-184255 A 7/1996

* cited by examiner

*Primary Examiner*—Carlos Lugo
(74) *Attorney, Agent, or Firm*—Pearne & Gordon LLP

(57) ABSTRACT

A telescopic stay comprises a stay body including an inner arm and an outer arm into which the inner arm is slidably fitted. In order to lock the inner and outer arms in a predetermined superposed position, a locking rod engages a locking hole in the inner arm by a locking spring disposed in a guide member attached onto the outer arm, but the guide member has a base portion passing through a flat board of the outer arm and a locking spring urges the guide member so that the base portion is forced against the inner face of the flat board portion. This requires no specific operation for securing the guide member and therefore the telescopic stay can be assembled with a reduced number of parts.

9 Claims, 6 Drawing Sheets

TELESCOPIC STAY

TECHNICAL FIELD

This invention relates to a telescopic stay adapted to support various swinging members such as a swinging type opening and closing cover or a door of an article or a building at a predetermined angle and especially to a telescopic stay having an improvement on attachment of a guide member for guiding a locking rod to lock at a predetermined telescopic position inner and outer arms slidably fitted to each other.

BACKGROUND OF TECHNOLOGY

In general, such a telescopic stay comprises a stay body including an inner arm (a first arm) and an outer arm (a second arm) into which the inner arm is slidably fitted and lock means to lock the inner and outer arms of the stay body in a predetermined superposed position. The lock means comprises a locking rod urged toward the inner arm by a locking spring disposed in a guide cylinder attached onto the outer arm and a locking hole provided in the guide cylinder and with which the locking rod is engaged so as to lock the inner and outer arms (see the Patent Document 1). The locking rod has a knob secured to the leading portion of the locking rod protruding from the guide cylinder whereby the locking rod is removed out of the locking hole by pulling up the knob against the locking spring so as to release the locking state.

In the conventional telescopic stay, the guide cylinder of the lock means is attached by passing through an attachment hole in a flat board portion of the outer arm and has a thinned small diameter portion provided at the lower edge of the guide cylinder. The guide cylinder is attached onto the outer arm by caulking the thinned small diameter portion from the inside of the outer arm so as to hold the guide cylinder between the shoulder of the thinned small diameter portion and the caulked portion (see FIG. 4 of Patent Document 1 and its explanation portion).

In such a construction, however, the structure for attaching the guide cylinder onto the outer arm is complicated and especially the operation of caulking the thinned small diameter portion of the guide cylinder in the narrow inner space of the outer arm is extremely difficult, which disadvantageously causes the attachment operation to be troublesome.

Patent Document 1: JP 6-40825Y

An object of the invention is to provide a telescopic stay in which an attachment operation of a guide member is simplified and an assembling of the stay can be easily made.

Another object of the invention is to provide a telescopic stay adapted to be assembled without any specific operation of attaching the guide member.

DISCLOSURE OF THE INVENTION

A fundamental feature of the invention is to provide a telescopic stay comprising a stay body including an inner arm and an outer arm into which the inner arm is slidably fitted and lock means to lock the inner and outer arms of the stay body in a predetermined superposed position, the lock means comprising a locking rod urged toward the inner arm by a locking spring disposed in a guide member attached onto the outer arm and a locking hole provided in the inner arm and with which the locking rod is engaged so as to lock the inner and outer arms, characterized in that guide member of the lock means has a base portion engaging an inner face of the flat board portion of the outer arm and the locking spring further urges the guide member so that the base portion of the guide member is forced against the inner face of the flat board portion.

In the fundamental feature of the invention, the guide member of the lock means may have a cylindrical portion provided at the base portion and passing through the flat board portion of the outer arm.

Also, in the fundamental feature of the invention, the engagement of the base portion of the guide member with the flat board portion of the outer arm may be preferably made and the engagement can be accomplished by an engagement protrusion provided on the base portion and engaged with an engagement portion of the flat board portion of the outer arm. In this case, the engagement portion may be a locking hole.

The guide member may preferably have a spring engagement portion of the cylindrical portion with which the upper end of the spring is engaged for being subject to the urging of the spring.

In this manner, since the guide member of the lock means has the base portion engaging the inner face of the outer arm and the spring urging the locking rod also urges the guide member so that the base portion of the guide member is forced against the inner face of the flat board portion, the locking spring has the function of securing the guide member to the outer arm. Thus there is not required any specific means to secure the guide member to the outer arm, which causes the attachment structure of the guide member is simplified and in addition thereto the troublesome operation of the caulking the guide member is not required, which enables the provision of the telescopic stay adapted to be easily assembled in an inexpensive manner.

BRIEF DESCRIPTION OF THE DRAWINGS

FIG. 6(A) is a front view thereof, FIG. 6(B) is an upper view thereof and FIG. 6(C) is a back view thereof and FIG. 7 is an enlarged cross sectional view of a knob used for the telescopic stay of FIG. 1

BEST MODE OF EMBODIMENT OF INVENTION

Figure 1:
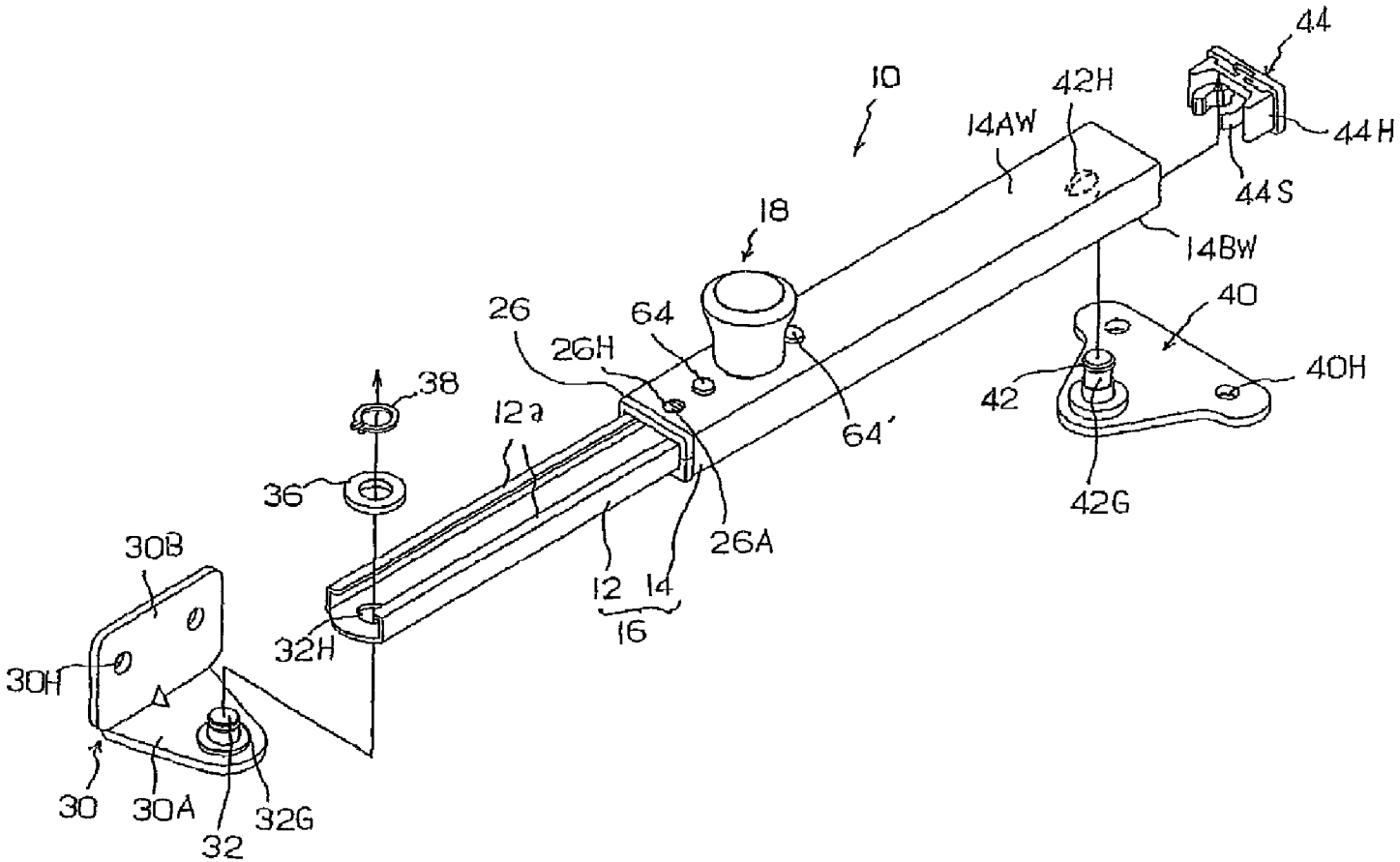
FIG. 1 is a perspective view of the telescopic stay with a bracket thereof removed out of the stay.
Figure 2:
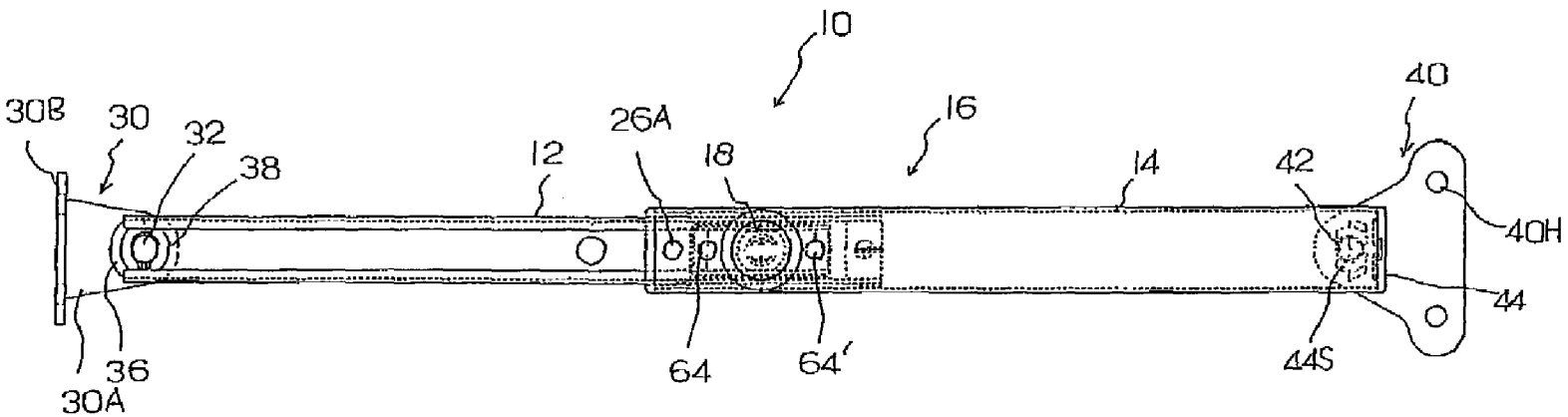
FIG. 2 is a front view of the telescopic stay of FIG. 1.
Figure 3:
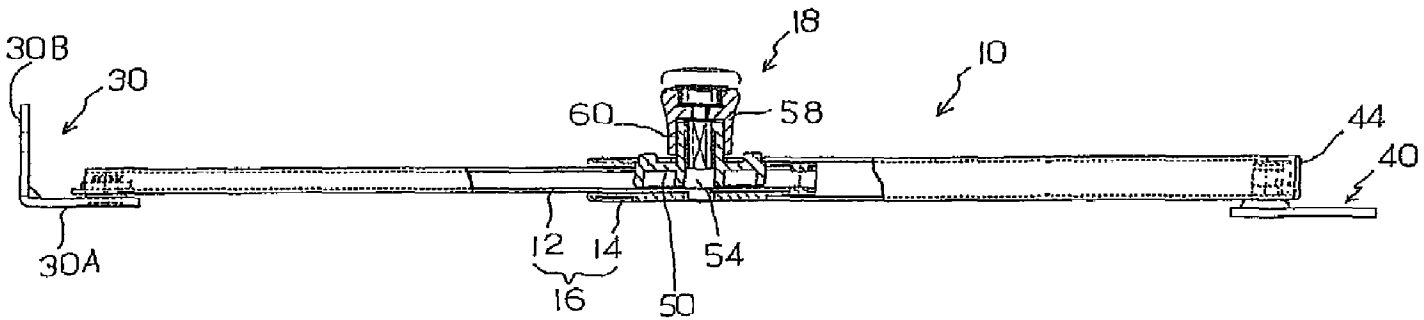
FIG. 3 is a side view of the telescopic stay of FIG. 1.

Describing a form of embodiment of the invention with reference to the drawings, FIGS. 1 through 5 illustrates a telescopic stay 10 constructed in accordance with one form of embodiment of the invention. This telescopic stay 10 comprises a stay body 16 including an inner arm 12 and an outer arm into which the inner arm 12 is slidably fitted and lock means 18 to lock the inner and outer arms 12 and 14 of the stay body 16 in a predetermined superposed position. The inner and outer arms 12 and 14 may be formed of appropriate metal materials such as stainless steel or others.

Figure 4:
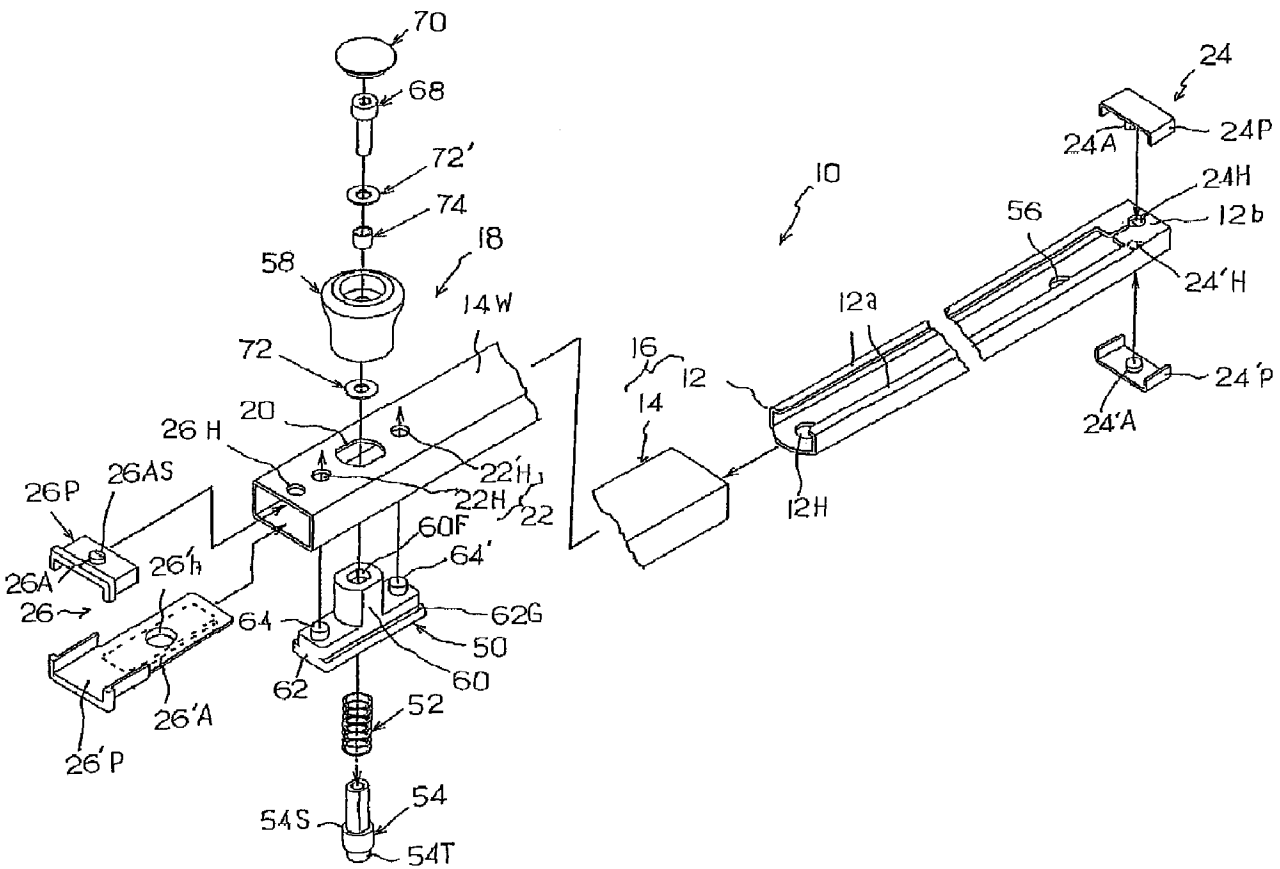
FIG. 4 is an explosive perspective view of the telescopic stay of FIG. 1.

In the illustrated embodiment, as noted from FIG. 4, the inner arm 12 may be in the form of appropriately U-shaped cross section and may have protrusion edges 12*a* provided on the upper opening side and extending toward the inside in a horizontal manner, but may be closed in the upper side at the non-attachment end thereof (the rightward end of FIG. 4) as indicated by a reference numeral 12*b*. The outer arm 14 may be in the form of rectangular cross section and may be provided in one of the flat board portions with a cylindrical through-hole 20 through which a later described guide member of the lock means 18 passes and also with an engagement portion 22 of engagement holes 22H and 22'H into which engagement protrusions of the later described guide member are fitted. As noted from FIG. 4, the cylindrical though-hole 20 may have approximately rectangular form.

The inner arm 12 may have a slider 24 comprising upper and lower slider pieces 24P and 24'P attached onto the closed non-attachment end so as to hold the non-attachment end between the slider pieces 24P and 24'P and the outer arm 14 may have a slider 26 comprising upper and lower slider pieces 26P and 26'P inserted into and attached onto the closed non-attachment end (the leftward end of FIG. 4). The non-attachment end of the inner arm 12 may slide while the slider 24 engages the inner face of the outer arm 14 and the remaining portion of the inner arm 12 may slide while the remaining portion engages the slider 26 of the outer arm 14. Thus, the body of the inner arm 12 slides the inside of the outer arm 14 in the state where the portion of the inner arm 12 except to the portion having the slider 24 never contacts the upper and lower flat board portions of the outer arm 14. In the specification, what is meant by the "non-attachment end" is the end opposite to the end of the telescopic stay attached onto a door or a body opened or closed by the door.

Figure 5:
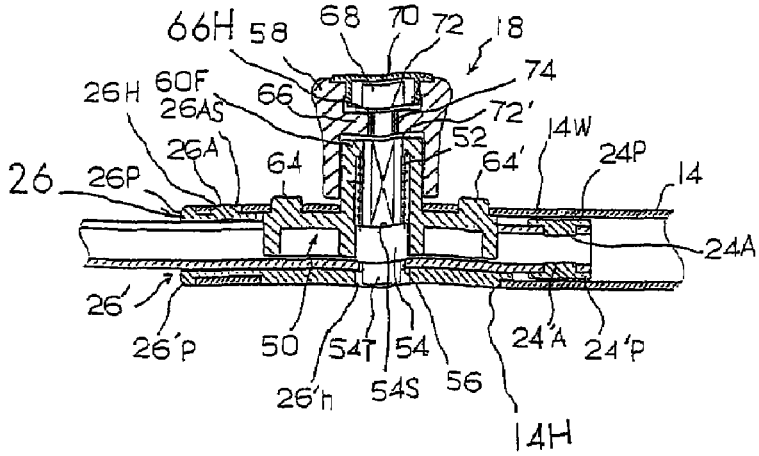
FIG. 5 is an enlarged cross sectional view of the feature of the invention.

The slider pieces 24P and 24P may have protrusion pins 24A and 24'A provided on the faces opposing to each other. These protrusion pins 24A and 24'A are forcibly fitted into the attachment holes 24H and 24'H of the inner arm 12 whereby the slider pieces 24P and 24'P are secured to the inner arm 12. As shown in FIGS. 4 and 5, the slider piece 26P may have a protrusion 26A provided on the outer face thereof and the protrusion 26A is forcibly fitted into the attachment hole 26H of the outer arm 14 whereby the slider piece 26P is secured to the outer arm 14. As shown in FIGS. 4 and 5, the slider piece 26'P may have a protruded board portion 26'A provided on the outer face thereof and the protruded board portion 26'A is forcibly fitted into a rectangular engagement hole 14H of the outer arm 14 whereby the slider piece 26'A is secured to the outer arm 14.P. The engagement hole 14H may also have the function of the hole through which a guide member 50 passes when the guide member 50 should be assembled within the outer arm 14, which will be described later relevant to the assembling of the stay.

On the attachment end of the inner arm 12 (the leftward end of FIG. 1) is pivotally attached an approximately L-shaped bracket 30, for example, which is in turn to be attached by screws to a back face of an opening and closing member such as a door of a not shown container box. More particularly, as noted from FIGS. 1 and 3, a pin 32 provided on an attachment piece 30A of the bracket 30 passes through the attachment hole 32H provided in the attachment end of the inner arm 12, a washer 36 is fitted onto the portion of the pin 32 protruding within the inner arm 12 and a C-shaped stopper ring 38 is placed on the washer 36 and fitted into an engagement groove 32G provided in the pin 32 whereby the bracket 30 is pivotally attached onto the inner arm 12. A fixture piece 30B of the bracket 30 has screw pass-through holes 30H and the bracket 30 is secured to the opening and closing member by the screws passing through the holes 30H and threaded into the opening and closing member.

On the attachment end of the outer arm 14 (the rightward end of FIG. 1) is pivotally attached an approximately triangle-shaped flat board-like bracket 40, which is to be secured to an opening edge of the container box, for example by screws. More particularly, as noted from FIGS. 1 and 2, a pin 42 provided on the bracket 40 adjacent to the top of the triangle passes through an attachment hole 42H provided in the other flat board portion 14BW of the outer arm 14 and a holder 44 is fitted into an annular groove in the portion of the pin 42 protruding within the outer arm 14 whereby the holder 44 resiliently holds the pin 42. The holder 44 may comprise a C-shaped spring 44S for holding the pin 42 on the annular groove 42G thereof and a fitting-in portion 44H holding the spring 44S and capable of being fitted into the attachment end of the outer arm 14 from the opening thereof. The bracket 40 has screw pass-through holes 40H and the bracket 40 is secured to the opening edge of the container box by screws passing through the screw pass-through holes 40H As noted from FIGS. 4 and 5, the lock means 18 comprises a locking rod 54 disposed within a guide member 50 attached onto the arm 14 and urged by a locking spring 52 and a locking hole 56 provided in the inner arm 12 and with which the locking rod 54 is engaged so as to lock the inner and outer arms 12 and 14. The lock means 18 further comprises a crown-like knob 58 secured to the top of the locking rod 54 for removing the locking rod 54 out of the locking hole 56 against the locking spring 52. As shown in FIG. 4, the locking hole 56 is provided in the inner arm 12 on the rightward side thereof so that the locking rod 54 is engaged with the locking hole 56 in the state where the stay is extended.

As shown in FIGS. 4 and 5, the guide member 50 of the lock means 18 comprises a cylindrical portion 60 passing through the cylindrical pass-through hole 20 provided in the flat board portion 14AW of the outer arm 14 and a base portion 62 provided integrally with the cylindrical portion 60 and engaging the inner face of the flat board portion 14AW.

Figure 6:
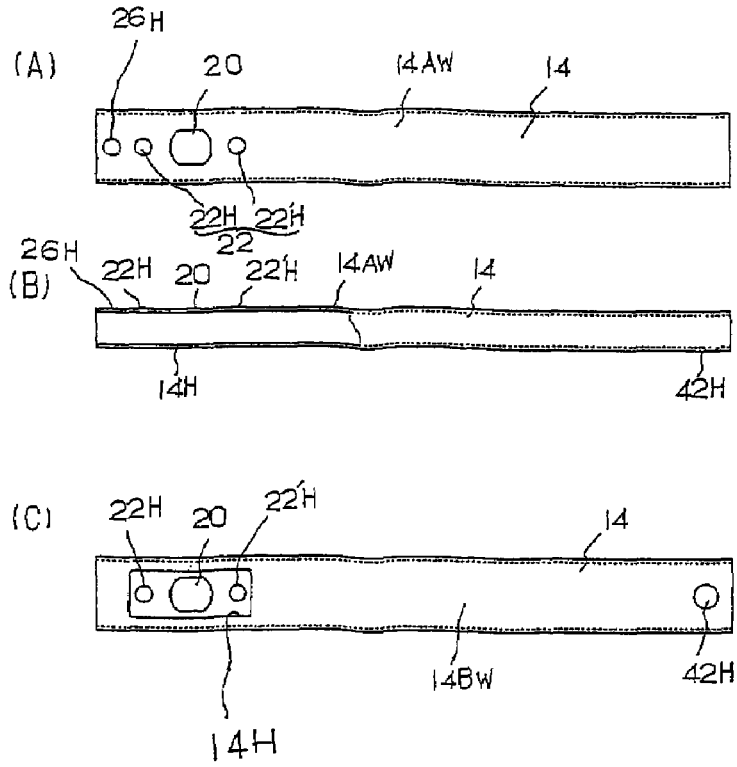
FIG. 6 illustrates an outer arm used for the telescopic stay of FIG. 1.
Figure 7:
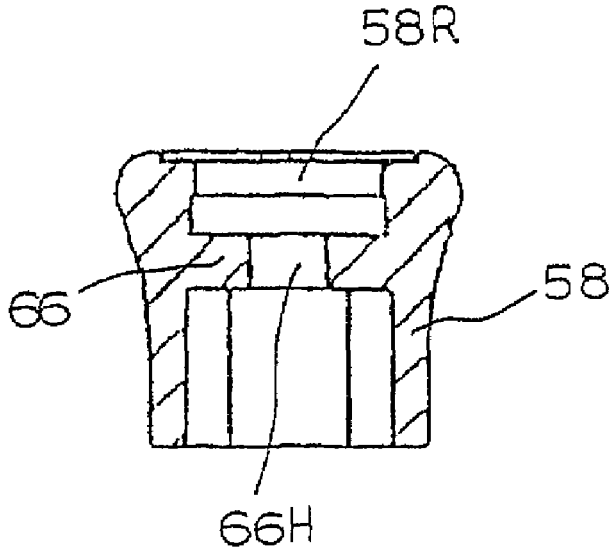

As noted from FIG. 4, the cylindrical portion 60 of the guide member 50 has the outer periphery of approximately rectangular cross section corresponding to the configuration of the cylindrical pass-through hole 20 and therefore it is attached onto the outer arm 14 in the state where it cannot rotate as it pass through the cylinder through-hole 20 to be attached onto the outer arm 14. As noted from FIG. 4, the base portion 62 has the form of flat board extending in a horizontal manner from both sides of the cylindrical portion 60 and has escape grooves 62G provided on both sides thereof and with which the protrusion rims 12*a* of the inner arm 12 is engaged to allow the inner arm 12 to move in a longitudinal direction. As already described, the guide member 50 can enter the outer arm 14 through the slider engagement hole 14H (see FIGS. 6(B) and 6(C)) provided in the flat board portion 14BW of the outer arm 14.

The locking spring 52 is disposed between the spring engagement portion 60F in the form of inner flange provided on the upper end of the cylindrical portion 60 and the shoulder portion 54S of the locking rod 54 to urge the rod 54 downward as viewed in FIG. 5 so as to engage the leading portion 54T of the locking rod 54 with the locking hole 56 and also to urge the cylindrical portion 60 of the guide member 50 upward as viewed in FIG. 5 so as to engage the base portion 62 thereof with the inner face of the flat board portion 14AW of the outer arm 14. Thus, it will be noted that the guide member 50 forces the base portion 62 against the outer arm 14 by urging of the locking spring 54 whereby the guide member 50 is secured to the outer arm 14.

The base portion 62 of the guide member 50 has engagement protrusions 64 and 64' entering the engagement holes 22H and 22'H in the flat board portion 14AW of the outer arm 14 to be engaged with the flat board portion 14AW and therefore, the guide member 50 is positively secured to the outer arm 14 by the engagement of the cylindrical portion 60 and the engagement protrusions 64 and 64' with the flat board portion 14AW of the outer arm 14 as well as the urging of the locking spring 54. Although, in the illustrated form, the engagement portion 22 with which the engagement protrusions 64 and 64' are engaged comprises the engagement holes 22H and 22'H, it may alternatively comprise engagement grooves.

The knob 58 is attached onto the locking rod 54 so as to cover the cylindrical portion 60 of the guide member 50. More particularly, the knob 58 has a middle wall 66 provided inside and a headed bolt 68 passes through a bolt through-hole 66H in the middle wall 66 and is threaded into the locking rod 54 whereby the knob 58 is secured to the locking rod 54. A cap 70 covers a recess 58R in the knob 58 so that it conceals the head of the headed bolt 68 positioned in the recess 58R in the top of the knob 58. In FIG. 5, reference numerals 72 and 72' designate washers inserted between the middle wall 66 of the knob 58 and the head of the locking rod 54 and between the middle wall 66 and the head of the headed bolt 68, respectively and a reference numeral 74 designates a spacer disposed at the portion where the headed bolt 68 passes through the middle wall 66.

Next, explaining the method of assembling the telescopic stay of the invention, as shown in FIG. 4, the guide member 50 passes through the engagement hole 14H for engagement of the slider of the outer arm 14 and enters the outer arm 14 and then the locking spring 52 and the locking rod 54 are inserted into the cylindrical portion 60 of the guide member 50.

The spacer 74 is inserted into the bolt through-hole 66H in the middle wall 66 of the knob 58 and the headed bolt 68 passes through the bolt through-hole 66H. The locking rod 54 is held between thee washers 72 and 72', the knob 58 covers the cylindrical portion 60 of the guide member 50 and the headed bolt 68 is tightly threaded into the lock rod 54 whereby the knob 58 is attached to the locking rod 54 and also the base portion 62 of the guide member 50 is forced against the inner face of the flat board portion 14AW of the outer arm 14. The recess 58R in the knob 58 is concealed by the cap 70 fitted into the recess 58R.

Thereafter, the lower slider piece 26'P is drawn into the outer arm 14 until the protrusion board portion 26'A is engaged with the engagement hole 14H while the locking rod 54 is released from the locking hole 56 by the knob 58 and then the upper slider piece 26A is forced into the outer arm 14. Since the engagement protrusion 26A of the upper slider piece 26P has an inclination face 26AS inclining gradually upward in the drawn-in direction as shown in FIG. 5, the upper slider piece 26P is drawn into the outer arm 14 while it is pushed down along the inclination face 26AS and when the engagement protrusion 26A is faced to the hole 26H, the engagement protrusion 26A is engaged with the engagement hole 26H whereby the upper and lower slider pieces 26P and 26'P are secured to the outer arm 14. As the knob 58 is released, the locking rod 54 is engaged with a locking rod escape hole 26'h in the lower slider piece 26', but the escape hole 26'h may be omitted.

After the upper and lower slider pieces 24P and 24'P are attached onto the non-attachment end of the inner arm 12, the latter is inserted into the outer arm 14 through the opening of the attachment ends thereof and the attachment end of the inner arm 12 is pulled out of the opening of the non-attachment end of the outer arm 14 (see FIG. 1). This operation is performed while the knob 58 is raised up in the lock-releasing direction.

Thereafter, the bracket 30 is attached onto the attachment end of the inner arm 12 and the bracket 40 is attached onto the attachment end of the outer arm 14 whereby the assembling of the telescopic stay 10 is completed.

The telescopic stay 10 can be used for the container box by attaching the brackets 30 and 40 by screws onto the cover and the box body of the container box, respectively, for example. The cover can be opened while the inner arm 12 of the telescopic stay 10 is pulled out so as to extend the telescopic stay 10. As the knob 58 is released in order to maintain the opened state, the locking rod 54 is engaged with the locking hole 56 by the locking spring 52 whereby the extension state of the telescopic stay 10 can be maintained. When the cover is to be closed, the knob 58 is raised up against the locking spring 52 and the cover can be closed while the inner arm 12 is pulled in the outer arm 14.

According to the telescopic stay 10 of the invention, since the guide member 50 of the lock means 18 has the base portion 62 engaging the inner face of the flat board portion 14AW of the outer arm 14 and the locking spring 52 urging the locking rod 54 also urges the guide member 50 so that the base portion 62 of the guide member 50 is engaged with the inner face of the flat board portion 14AW, the locking spring 52 has the function of securing the guide member 50 to the outer arm 14. Thus, it will be noted that there is required no specific means to secure the guide member 50 to the outer arm 14.

In the aforementioned form of embodiment, the cylindrical portion 60 is provided integrally with the base portion 62, but since the hole in the base portion 62 has the guide function for the locking rod 54, the cylindrical portion 50 passing through the flat board portion 14AW of the outer arm 14 may be omitted.

POSSIBILITY OF UTILIZATION IN INDUSTRIES

According to the invention, since the locking spring urging the locking rod 54 so as to engage the locking rod with the locking hole also has the function of securing the guide member 50 guiding the locking rod to the outer arm 14 by forcing the guide member against the inner face of the outer arm, there is required no specific means to secure the guide member to the outer arm, which enables the assembling of the telescopic stay to be made easier with the result that the possibility of utilization in industries can be improved.

The invention claimed is:

1. A telescopic stay comprising a stay body including an inner arm and an outer arm into which said inner arm is slidably fitted and lock means to lock said inner and outer arms of said stay body in a predetermined superposed position, said lock means comprising a locking rod urged toward said inner arm by a locking spring disposed in a guide member attached onto said outer arm, a knob attached to the locking rod and a locking hole provided in said inner arm and with which said locking rod is engaged so as to lock said inner and outer arms, characterized in that said guide member has a base portion engaging an inner face of the flat board portion of said outer arm and said locking spring further urges said guide member so that said base portion of said guide member is forced against the inner face of said flat board portion of said outer arm, wherein when the knob is pulled, the locking rod would move away from the locking hole at said inner arm in order to unlock the engagement between the outer arm and the inner arm, and biased by the locking spring to move the locking rod toward the inner arm in order to lock in place the outer arm with respect to the inner arm.

2. A telescopic stay as set forth in claim 1, wherein said base portion of said guide member and said flat board portion of said outer arm are engaged with each other.

3. A telescopic stay as set forth in claim 1, wherein said base portion of said guide member has at least one engagement protrusion engaging an engagement portion of said flat board portion of said outer arm.

4. A telescopic stay as set forth in claim 3, wherein said engagement portion of said flat board portion of said outer arm is an engagement hole.

5. A telescopic stay comprising a stay body including an inner arm and an outer arm into which said inner arm is slidably fitted and lock means to lock said inner and outer arms of said stay body in a predetermined superposed position, said lock means comprising a locking rod urged toward said inner arm by a locking spring disposed in a guide member attached onto said outer arm, a knob attached to the locking rod and a locking hole provided in said inner arm and with which said locking rod is engaged so as to lock said inner and outer arms, characterized in that said guide member of said lock means has a cylindrical portion extending through a flat board portion of said outer arm and a base portion engaging an inner face of said flat board portion of said outer arm and said locking spring further urges said guide member so that said base portion of said guide member is forced against the inner face of said flat board portion of said outer arm, wherein when the knob is pulled, the locking rod would move away from the locking hole at said inner arm in order to unlock the engagement between the outer arm and the inner arm, and biased by the locking spring to move the locking rod toward the inner arm in order to lock in place the outer arm with respect to the inner arm.

6. A telescopic stay as set forth in claim 5, wherein said cylindrical portion of said guide member has a spring engagement portion with which an upper end of said spring is engaged.

7. A telescopic stay as set forth in claim 5, wherein said base portion of said guide member and said flat board portion of said outer arm are engaged with each other.

8. A telescopic stay as set forth in claim 5, wherein said base portion of said guide member has at least one engagement protrusion engaging an engagement portion of said flat board portion of said outer arm.

9. A telescopic stay as set forth in claim 8, wherein said engagement portion of said flat board portion of said outer arm is an engagement hole.

* * * * *